US009940786B1

(12) United States Patent
Lucci

(10) Patent No.: US 9,940,786 B1
(45) Date of Patent: Apr. 10, 2018

(54) GAMING SYSTEM WITH DYNAMIC PRIZING

(71) Applicant: Anthony Lucci, North Kingstown, RI (US)

(72) Inventor: Anthony Lucci, North Kingstown, RI (US)

( * ) Notice: Subject to any disclaimer, the term of this patent is extended or adjusted under 35 U.S.C. 154(b) by 17 days.

(21) Appl. No.: 15/006,774

(22) Filed: Jan. 26, 2016

Related U.S. Application Data

(60) Provisional application No. 62/107,818, filed on Jan. 26, 2015.

(51) Int. Cl.
*G07F 17/32* (2006.01)

(52) U.S. Cl.
CPC ..... *G07F 17/3239* (2013.01); *G07F 17/3251* (2013.01); *G07F 17/3258* (2013.01); *G07F 17/3286* (2013.01)

(58) Field of Classification Search
USPC ..... 463/26
See application file for complete search history.

(56) References Cited

U.S. PATENT DOCUMENTS

2008/0254893 A1* 10/2008 Patel ..... G07F 17/3267 463/42
2012/0004746 A1* 1/2012 Kelly ..... G07F 17/3267 700/91
2012/0108323 A1* 5/2012 Kelly ..... G07F 17/3239 463/26
2014/0171197 A1* 6/2014 Kelly ..... G07F 17/3267 463/31
2015/0199868 A1* 7/2015 Kelly ..... G07F 17/3225 463/25

* cited by examiner

*Primary Examiner* — Pierre E Elisca
(74) *Attorney, Agent, or Firm* — Fish & Richardson P.C.

(57) ABSTRACT

Methods, systems, and apparatus, including computer programs encoded on a computer storage medium, for dynamically managing the distribution of prizes in a gaming system. In one aspect, a method includes initializing a digital interactive sweepstakes game, receiving player identification data, receiving player activity data, determining a player activity forecast based on the player activity data, updating a prizing algorithm based on the player activity forecast, applying the prizing algorithm to player activity data to identify a particular player, and distributing a prize to an account associated with the particular player.

7 Claims, 9 Drawing Sheets

GAMING SYSTEM WITH DYNAMIC PRIZING

CROSS-REFERENCE TO RELATED APPLICATIONS

This patent application claims the benefit of U.S. Provisional Patent Application No. 62/107,818, filed Jan. 26, 2015. The content of U.S. Provisional Patent Application No. 62/107,818 is hereby incorporated by reference into this application as if set forth herein in full.

TECHNICAL FIELD

This disclosure relates to gaming systems with dynamic prizing.

BACKGROUND

In recent years, the interest in old-style arcade games has increased. While this style of entertainment has been until recently relegated to a small market driven primarily by nostalgia, in recent years interest has grown considerably, primarily driven by a cultural shift that has made interest in the games of "Gen X" extremely popular.

SUMMARY

Although this market may be growing, this growth is primarily seen in small local establishments that have built novel dining and "pub style" destinations. These smaller establishments often lack the marketing budgets to attract and maintain a stable clientele. Given this, the techniques described herein seek to bring, in some implementations, a novel and unique concept to the arcade game market that provide consumers with an incentive to frequent such establishments, while providing business owners and others associated with such establishments with additional streams of revenue and new insight into the demographics and buying patterns of their clientele.

In general, an aspect of the subject matter described in this specification may relate to a method and apparatus for allowing a sponsor/administrator of games to align the distribution of prizes that are to be awarded over the course of a sweepstakes with player activity levels. These games may include interactive games that allow participants/players to enter a sweepstakes or similar drawing by playing such games on gaming systems. As player activity increases or decreases, the number of prizes that are made available to players from one or more pre-established prize pools, or "pools," would also increase or decrease, with more prizes available during higher periods of player activity, and fewer during lower periods of player activity.

In some aspects, the subject matter described in this specification may be embodied in methods for the dynamic distribution of prizes that may include the actions of initializing a digital interactive sweepstakes game, where initialization of the digital interactive sweepstakes game includes setting one or more game parameters, receiving, at an electronic processor, player identification data from a plurality of card acceptor terminals, each card acceptor terminal being coupled to a different corresponding gaming device, where the player identification data from each card acceptor terminal is received responsive to the operation of a corresponding card at the card acceptor terminal, receiving at the processor, from the plurality of gaming devices, player activity data while the gaming devices are played, determining, by the processor, a player activity forecast based, at least in part, on the received player activity data, updating a prizing algorithm based on the player activity forecast, applying, by the processor, the prizing algorithm to the received player activity data to identify a particular player to which a prize is to be distributed, and responsive to identifying the particular player to which the prize is to be distributed, distributing the prize to a player account that is associated with the particular player and that is identified by the player identification data.

Other implementations of this and other aspects include corresponding systems, apparatus, and computer programs, configured to perform the actions of the methods, encoded on computer storage devices. A system of one or more computers can be so configured by virtue of software, firmware, hardware, or a combination of them installed on the system that in operation cause the system to perform the actions. One or more computer programs can be so configured by virtue of having instructions that, when executed by data processing apparatus, cause the apparatus to perform the actions.

These other versions may each optionally include one or more of the following features. For instance, distributing the prize to the player account associated with the particular player may, in some examples, include transmitting prize data from the processor to the player account stored on a card operated at one of the card acceptor terminals.

Implementations may include updating the one or more game parameters based, at least in part, on the player activity data, where the one or more game parameters include a size of a prize pool, a quantity of prizes to be distributed from the prize pool, and/or a target frequency for awarding prizes from the prize pool. In such implementations, updating the game parameters based on the player activity data may, in some instances, include changing the size of the prize pool, changing the quantity of prizes to be distributed from the prize pool, and/or changing the duration of the sweepstakes.

In some examples, the player activity forecast may include an estimate of a number of prize entries over a predetermined time period. In some instances, the prizing algorithm may include randomly activating prizes from the prize pool according to a prize distribution rate so as to maintain a predetermined ratio of number of prizes distributed to a number of prize entries, and where the method includes updating the prize distribution rate based on the player activity forecast. In such instances, updating the prize distribution rate based on the player activity forecast may also include increasing the prize distribution rate responsive to an increase in the player activity forecast and decreasing the prize distribution rate responsive to a decrease in the player activity forecast. In other instances, the prizing algorithm may include activating prizes from the prize pool according to a predetermined schedule, and where the method includes modifying the predetermined schedule based on the player activity forecast. In such other instances, modifying the predetermined schedule based on the player activity forecast may include increasing a frequency with which prizes are activated responsive to an increase in player activity forecast and decreasing a frequency with which prizes are distributed responsive to a decrease in the player activity forecast.

In some implementations, the prizing algorithm may include specifying a predetermined trigger event, activating the prize from the prize pool according to a prize distribution rate or according to a predetermined schedule, identifying, from the player activity data, the first predetermined trigger event to occur subsequent to activating the prize, and identifying the particular player having caused the predetermined trigger event as the particular player to which the activated prize should be distributed. The predetermined trigger event may, for example, include initiating a game on one of the plurality of gaming devices. In addition, the predetermined trigger event may include performing an action within a game being played on one of the plurality of gaming devices.

In some examples, actions may further include outputting to a display, an interactive dashboard control panel, the interactive dashboard control panel including one or more interactive controls that allow a user to modify the one or more game parameters including a size of a prize pool, a quantity of prizes to be distributed from the prize pool, and/or a target frequency for awarding prizes from the prize pool.

In some aspects, the subject matter described in this specification may be embodied in methods for the dynamic distribution of prizes that may include the actions of initializing a digital interactive sweepstakes game, where initialization of the digital interactive sweepstakes game includes setting one or more game parameters, receiving, at an electronic processor, player identification data from each of a plurality of gaming devices, each gaming device being a computing device that participates in the digital interactive sweepstakes game, receiving, at the processor, from the plurality of gaming devices, player activity data while players are interacting with the plurality of gaming devices, determining, by the processor, a player activity forecast based, at least in part, on the received player activity data, updating a prizing algorithm based on the player activity forecast, applying, by the processor, the prizing algorithm to the received player activity data to identify a particular player to which a prize is to be distributed, and responsive to identifying the particular player to which the prize is to be distributed, distributing the prize to a player account that is associated with the particular player and that is identified by the player identification data.

Other implementations of this and other aspects include corresponding systems, apparatus, and computer programs, configured to perform the actions of the methods, encoded on computer storage devices. A system of one or more computers can be so configured by virtue of software, firmware, hardware, or a combination of them installed on the system that in operation cause the system to perform the actions. One or more computer programs can be so configured by virtue of having instructions that, when executed by data processing apparatus, cause the apparatus to perform the actions.

These other versions may each optionally include one or more of the following features. For instance, receiving, at the electronic processor, player identification data from each of the plurality of gaming devices may include receiving, at the electronic processor and from each gaming device, data referencing a player account that is associated with a player of the respective gaming device, as indicated to the respective gaming device through interaction between the respective gaming device and the player of the respective gaming device. In some implementations, interactions between the respective gaming device and the player of the respective gaming device include accessing, by the player interacting with the respective gaming device, one or more applications running on the respective gaming device, playing one or more games on the respective gaming device, attaining achievements while playing one or more games on the respective gaming device, conducting one or more transactions while playing one or more games on the respective gaming device, and/or purchasing one or more items from one or more retailers. In addition, the player account that is associated with the player of the respective gaming device may, in some examples, be an account held in association with a dedicated payment card used with one or more applications or games running on the respective gaming device, a credit card, a debit card, and/or a gift card.

In some aspects, the techniques described herein may leverage a control panel that allows the sponsor to (i) set the initial parameters for the sweepstakes, such as estimates for player activity, the size and quantity of the prize pool(s), the duration of the sweepstakes, and the desired/target frequency for awarding intermediate prizes, b) to change these parameters, if desired, as the sweepstakes progresses based on data from the actual performance of the sweepstakes, and the degree of control that would be given to the player activity forecasting algorithm and Prizing Algorithm, ranging from "autopilot" to where these algorithms would manage the parameters over the course of the sweepstakes to fully manual where the sponsor would directly change the parameters, (ii) a player activity forecasting algorithm that monitors actual player activity, and creates a forecast for player activity within one or across multiple games, with each game supporting a single or multiple prize pools, (iii) a prizing algorithm that manages the distribution of prizes (e.g., either through mini-drawings or the random distribution) based on the parameters set in the control panel and on player activity within one or across multiple prize pools, and (iv) a dashboard that provides the sponsor with data regarding the performance of the sweepstakes including performance by game, player segment data, forecasted performance of the sweepstakes based on actual data, comparisons of actual vs. forecast data, and data that compares actual activity to the initial estimates.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF DRAWINGS

Like reference symbols in the various drawings indicate like elements.

DETAILED DESCRIPTION

Figure 1:
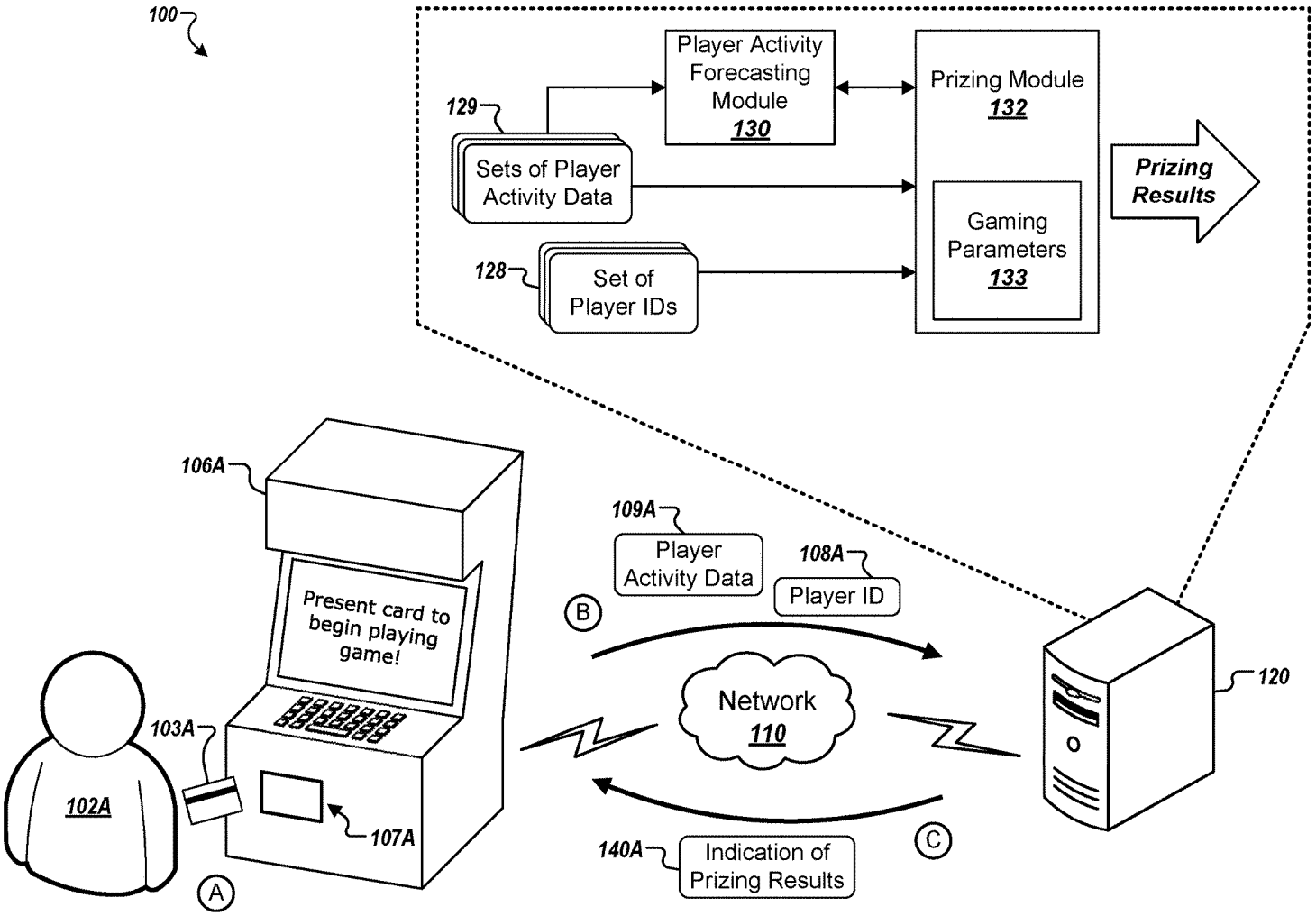
FIG. 1 is a conceptual diagram of an exemplary framework for dynamically managing the distribution of prizes in a gaming system.

FIG. 1 is a conceptual diagram of an exemplary framework for dynamically managing the distribution of prizes in a gaming system 100. More particularly, the diagram depicts a gaming device 106A in communication with a computing device 120 over a network 110, that collectively make up gaming system 100. The gaming device 106A may include a card acceptor terminal 107A that communicates with dedicated payment cards that are in proximity of the card acceptor terminal 107A. The diagram also depicts exemplary data that is communicated within gaming system 100 in time-sequenced stages "A" to "C," respectively.

In this example, a user 102A may be interacting with gaming device 106A, which may be that of a console for playing "arcade style" games. The user 102A may, for example, possess a dedicated payment card 103A that was purchased at an arcade or establishment that features "arcade style" games such as pin-ball games, video games, or similar games that are "play for fun" or non-casino games. The dedicated payment card 103A may bear data that represents a set amount of credits that may be applied to play various games in the arcade and across multiple arcade locations. In the example of FIG. 1, the user 102A may have also registered the dedicated payment card 103A and created a player account in association with the dedicated payment card 103A. For example, the user 102A may perform an online registration process using an interface provided by a website, application running on a client device being used by user 102A, kiosk or terminal provided at the arcade or point-of-sale of dedicated payment card 103A, and the like. During the registration process, the user 102A may provide input information to a registration interface, such as information about user 102A (e.g., name, email address, postal address, phone number, etc.), information about the dedicated payment card 103A (e.g., identification number printed on card, expiration date, barcode scanning compatibility, RFID reading compatibility, etc.), security information (e.g., user pin, password, etc.), user preferences, and the like.

The user 102A may initiate gameplay by presenting the dedicated payment card 103A to the card acceptor terminal 107A. In stage A, the gaming device 106A may obtain information contained on dedicated payment card 103A by way of card acceptor terminal 107A and, in response, provide the user 102A with access to a game that runs on gaming device 106A. The card acceptor terminal 107A may, for instance, obtain such information by reading a barcode or magnetic strip of the dedicated payment card 103A, or by receiving information from the dedicated payment card 103A through use of any of various wireless communication protocols including radio frequency identification ("RFID"), near field communication ("NFC"), Bluetooth, WLAN and other IEEE 802.11 standards, and/or optical communication. Once the dedicated payment card 103A has been activated on that game, gameplay on that game would also provide the user 102A with the opportunity to receive entries into the sweepstakes. In some examples, the gaming device 106A may provide an option to "opt in" or "opt out" of sweepstakes.

The user 102A may be entered into the sweepstakes every time a "qualifying event" occurs. Such qualifying events may, for instance, occur each time credits are used during gameplay (e.g., to continue the game or play another round), each time achievements are attained within the game (e.g., reaching certain levels within the game, earning a specific quantity of points, or achieving a certain ranking on a leaderboard, etc.), or a combination thereof. In stage B, the gaming device 106A may determine that a qualifying event has occurred and, in response, provide data including player ID 108A and player activity data 109A to computing device 120.

The player ID 108A may indicate any of a variety of information associated with user 102A, dedicated payment card 103A, and the player account associated with the dedicated payment card 103A. Such information may be directly communicated to the card acceptor terminal 107A by the dedicated payment card 103A or may be determined on the basis of one or more identifiers or pointers communicated to the card acceptor terminal 107A by the dedicated payment card 103A. The player activity data 109A received by the computing device 120 may, for instance, indicate the quantity of transactions conducted by user 102A during gameplay, the value of each transaction conducted by user 102A during gameplay, the time at which user 102A began playing the subject game on the gaming device 106A, the duration of gameplay, the amount of credits expended by user 102A during gameplay, indication of the occurrence of one or more qualifying events involving the user 102A, specific details about one or more qualifying events involving the user 102A, information about the gaming device that user 102A is currently playing (e.g., gaming device 106A), information stored in association with user 102A's player account, and the like.

The computing device 120 may, for instance, manage sweepstakes entries and, upon receiving player ID 108A and player activity data 109A from the gaming device 106A, may effectively enter user 102A into the sweepstakes or otherwise record credit usage for dedicated payment card 103A. In some examples, the computing device 120 may maintain information about the player account that is associated with the dedicated payment card 103A, so as to associate the received player ID 108A and player activity data 109A with user 102A. In turn, the player account that is associated with the dedicated payment card 103A may be updated for credit balances, sweepstakes entries, and prize activity.

In addition to communicating with the gaming device 106A, the computing device 120 may also communicate with multiple other gaming devices and systems over network 110. In this way, multiple other users may also be able to enter the sweepstakes. Each gaming device in communication with computing device 120 may provide data to computing device 120 upon determining that a qualifying event has occurred, so as to enter the respective user into the sweepstakes. For instance, the computing device 120 may receive a set of player IDs 128 and multiple sets of player activity data 129 from multiple different gaming devices over the course of a sweepstakes entry period. In one aspect, the set of player IDs 128 and sets of player activity data 129 may include information similar to that of player ID 108A and player activity data 109A, but for multiple users and gaming devices other than user 102A and gaming device 106A, respectively. Based at least on set of player IDs 128 and player activity data 129, the computing device 120 may determine how many entries there are for a sweepstakes and to whom each entry corresponds. In some examples, the computing device 120 may store and/or maintain data 128-129 in one or more databases.

The computing device may further include a player activity forecasting module 130 that applies a player activity forecasting algorithm and a prizing module 132 that applies a prizing algorithm. The player activity forecasting module 130 may provide one or more predictions about the player participation in a sweepstakes based on the sets of player activity data 129 that it receives from multiple gaming devices. In particular, the player activity forecasting module 130 may provide a forecast of the total quantity of users expected to play games associated with the sweepstakes during an upcoming period of time, the average quantity of transactions that each user is expected to conduct during the upcoming period of time, the total quantity of transactions that are expected to occur during the upcoming period of time, the average value of the transactions that are expected to occur during the upcoming period of time, the total value that is expected to be transacted during the upcoming period of time, the total quantity of sweepstakes entries that are expected to be provided during the upcoming period of time, and the like. Since player activity data may be received by the computing device 120 in real-time, the player activity forecasting module 130 may be capable of providing short-term forecasts of player activity in the relatively eminent future, as well as longer-term forecasts of player activity. The player activity forecasting module 130 may output its forecasts to the prizing module 132.

The prizing module 132 may identify sweepstakes winners based on gaming parameters 133, the set of player IDs 128, the sets of player activity data 129, and the player activity forecast that is output by the player activity forecasting module 130, and proceed to distribute prizes to the respective winners. In particular, the prizing module 132 may distribute prizes in a prize distribution rate so as to maintain a predetermined ratio of number of prizes distributed to a number of prize entries. In other words, the prizing module 132 may seek to distribute a predetermined quantity of prizes for every sweepstakes entry and do so in a continuous manner throughout the course of the sweepstakes. The predetermined ratio of number of prizes distributed to a number of prize entries is a constant that may be user-defined and indicated in the gaming parameters 133. In some examples, at least a portion of gaming parameters 133 may be initially defined by a sponsor or administrator of the sweepstakes through a control panel in communication with the computing device 120 over network 110. The prize distribution rate may also be indicated in the gaming parameters 133, but may be dynamically adjusted by the prizing module 132 so as to uphold the predetermined ratio of number of prizes distributed to a number of prize entries.

The prizing module 132 may specifically leverage the player activity forecast provided by the player activity forecasting module 132 to adjust one or more of gaming parameters 133. In some examples, the prizing module 132 may update one or more gaming parameters including sizes of prize pools, quantities of prizes that are to be distributed from each prize pool, the target frequency at which prizes are to be distributed from each prize pool, and the like. For instance, the prizing module 132 may adjust its prize distribution rate based on information included in the player activity forecast that indicates the total quantity of sweepstakes entries that are expected to be provided during an upcoming, predetermined period of time. That is, the prizing module 132 may determine that, for the total quantity of sweepstakes entries that are expected to be provided during the predetermined period of time, a particular quantity of prizes will need to be distributed over the course of the predetermined period of time in order to uphold the predetermined ratio of number of prizes distributed to a number of prize entries.

Upon updating the gaming parameters 133 according to the player activity forecast provided as output by the player activity forecasting module 130, the prizing module 132 may identify one or more particular users that entered the sweepstakes, as prize winners. That is, the prizing module 132 may pair each prize that is to be distributed with a respective user who entered the sweepstakes by playing a gaming device. The prizing module 132 may obtain prizing results using one or both of the two prizing structures that are described in further detail below in association with FIGS. 4A-5B. Responsive to identifying each user to which respective prizes are to be distributed, the prizing module 132 may distribute the respective prizes to each user. In some examples, the prizing module 132 outputs information that indicates prizing results for use by one or more computing devices of gaming system 100. The prizes that are awarded in such sweepstakes may include merchandise, cash, or other material that is dispensed by the gaming device 106A or other system that is on premise, additional credits that are added to player accounts, cash prizes that are credited to player accounts, or a combination thereof.

During gameplay, the gaming device 106A may display a "dashboard" or other user interface that indicates the amount of credits left on dedicated payment card 103A, sweepstakes entered using dedicated payment card 103A, quantity of sweepstakes entries associated with dedicated payment card 103A, and any prizing activity. In stage C, the computing device 120 may provide the gaming device 106A with indication of prizing results 140A that reflects the status of the sweepstakes, whether or not user 102A has won a prize, and the like. In some examples, the manner in which indication of prizing results 140A is presented may depend on one or more preferences indicated in user 102A's player account. Such indication of prizing results 140A may be displayed for the user 102A through the dashboard of gaming device 106A and, in the event that user 102A is a sweepstakes winner, may instruct gaming device 106A to dispense the appropriate prize. Similar indicia may be provided to the other gaming devices that communicate with the computing device 120. In some implementations, the user 102A may be able to access such information through use of a "mobile dashboard" provided by an application running on a mobile device being used by user 102A. In addition, the user 102A may be able to add funds to the dedicated payment card 103A through use of such user interfaces.

As mentioned above, these techniques support at least two prizing structures. In some implementations, the two prizing structures include a mini-drawing structure and a random distribution structure, each of which are provided at least in part by the player activity forecasting algorithm, the prizing algorithm, or other functionality of computing device 120.

The mini-drawing structure allows for players, again while playing a game, to receive a) an entry into a grand prize drawing that is held after the close of the sweepstakes, and/or b) the opportunity to be entered into intermediate "mini-drawings" that are held in between the launch and the close of the sweepstakes where the player can win prizes in advance of the final/main drawing.

Under the random distribution structure, a player, while playing a game, can be awarded a) an entry into a grand prize drawing that is held after the close of the sweepstakes, and/or b) can be awarded prizes that maybe randomly distributed over the course of the sweepstakes in advance of the final/main drawing.

With both prizing structures, a trigger event creates an opportunity for the player to win a prize. Trigger events may take place upon successful completion of events or activities within the game, such as the conducting of in-game transactions, or the achievement of certain levels or milestones within the game. Some trigger events may not require the player to pay any fees or consideration in order to successfully complete. Furthermore, this method also allows the sponsor to simultaneously and dynamically manage multiple prize pools within a sweepstakes, with each prize pool tied to specific activities or groups of activities within the game. For example, separate prize pools can be tied to specific transactions, or groups of similar transactions.

This method creates a dynamic environment that greatly enhances the appeal and effectiveness of the sweepstakes or drawing. By aligning the awarding of the intermediate prizes with player activity, a much more entertaining player experience is created, and by simultaneously and dynamically managing multiple prize pools, prizes can be allocated to activities in accordance to player levels within these activities.

In one aspect, each device included in gaming system 100 may each be implemented using, for example, one or more general-purpose computers capable of responding to and executing instructions in a defined manner, personal computers, special-purpose computers, workstations, servers, or mobile devices. Furthermore, the dedicated payment card 107A may be a card other storage device bearing a barcode, magnetic strip, or other indicia of an account of user 102A, a card other storage device that includes hardware for performing radio or optical communications with card acceptor terminal 107A, or a data processing device such as a mobile computing device, personal digital assistant, cellular telephone, smart-phone, or tablet that is configured to communicate with card acceptor terminal 107A or other computing devices associated with gaming device 106A and/or computing device 120. The network 110 may, in some examples, include one or more networks, such as a local area network, a wide area network, and/or the Internet. One or more of the networks in the network 110 may be wireless, such as a cellular telephone network or a Wi-Fi network. In addition, the computing device 120, gaming devices including gaming device 106A, card acceptor terminals including card acceptor terminal 107A, and/or other devices and systems described in association with gaming system 100 may rely upon one or more remotely-located devices such as servers, databases, and/or cloud computing devices to perform at least a portion of its functions as described herein.

In some implementations, the gaming devices described above in association with gaming system 100, such as gaming device 106A, may take the form of a mobile computing device, video game console, personal digital assistant, cellular telephone, smart-phone, tablet, payment terminal, point of sale ("POS") register or terminal, automated teller machine, vending machine, laptop, desktop, workstation, and other computing device. In such implementations, the gaming devices of gaming system 100 may not necessarily be coupled to or include card acceptor terminals. For instance, in examples in which a game is being played on a personal gaming device, such as a smart-phone or tablet, the user playing the game may conduct in-game transactions through use of a player account that the user has logged into to initiate gameplay. In some examples, player account information may be stored on the gaming device. In this way, users may be able to freely play games on their devices without having to input player identification or account information each time gameplay is initiated. In some examples, users may utilize a gaming device to perform one or more of the account creation and registration processes described above. In some instances, the user interface used for account creation and registration may be integrated with the "mobile dashboard" interface described above or a user interface provided by a gaming device through which gameplay may be initiated.

Figure 2:
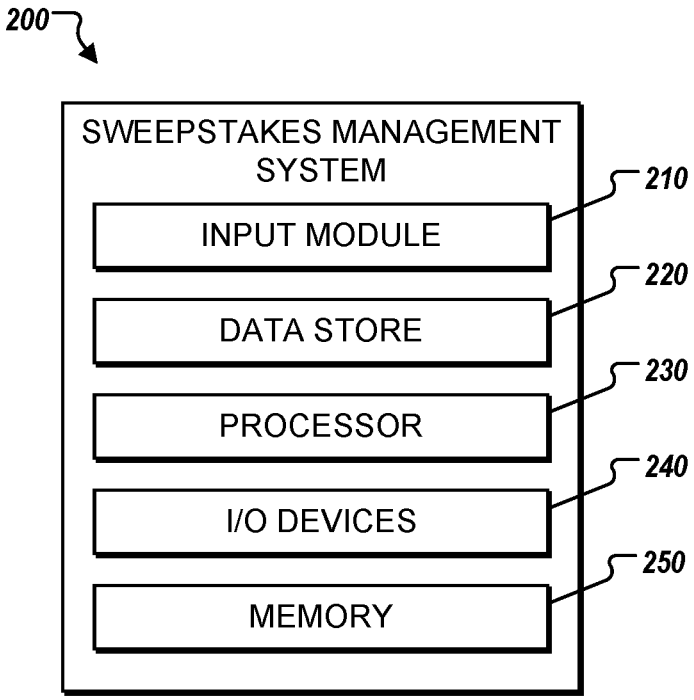
FIGS. 2-3 are diagrams of exemplary systems for dynamically managing the distribution of prizes.

FIG. 2 illustrates an exemplary system 200 for carrying out the functions described above. The system 200 includes an input module 210, a data store 220, one or more processors 230, one or more I/O (Input/Output) devices 240, and memory 250. The input module 220 may be used to input any type of information that may be utilized for providing digital interactive sweepstakes games with dynamic prizing. For example, the input module 210 may be used as part of the control panel or in cooperation with the control panel, as described above, to receive information required to perform the process described herein. In some implementations, data from the input module 210 is stored in the data store 220. The data included in the data store 220 may include, for example, parameters and other information utilized by the player activity forecasting and prizing algorithms.

In some examples, the data store 220 may be a relational database that logically organizes data into a series of database tables. Each database table in the data store 220 may arrange data in a series of columns (where each column represents an attribute of the data stored in the database) and rows (where each row represents attribute values). In some implementations, the data store 220 may be an object-oriented database that logically or physically organizes data into a series of objects. Each object may be associated with a series of attribute values. In some examples, the data store 220 may be a type of database management system that is not necessarily a relational or object-oriented database. For example, a series of XML (Extensible Mark-up Language) files or documents may be used, where each XML file or document includes attributes and attribute values. Data included in the data store 220 may be identified by a unique identifier such that data related to a particular process may be retrieved from the data store 220.

The processor 230 may be a processor suitable for the execution of a computer program such as a general or special purpose microprocessor, and any one or more processors of any kind of digital computer. In some implementations, the system 200 includes more than one processor 230. The processor 230 may receive instructions and data from the memory 250. The memory 250 may store instructions and data corresponding to any or all of the components of the system 200. The memory 250 may include read-only memory, random-access memory, or both.

The I/O devices 240 are configured to provide input to and output from the system 200. For example, the I/O devices 240 may include a mouse, a keyboard, a stylus, or any other device that allows the input of data. The I/O devices 240 may also include a display, a printer, or any other device that outputs data.

Figure 3:
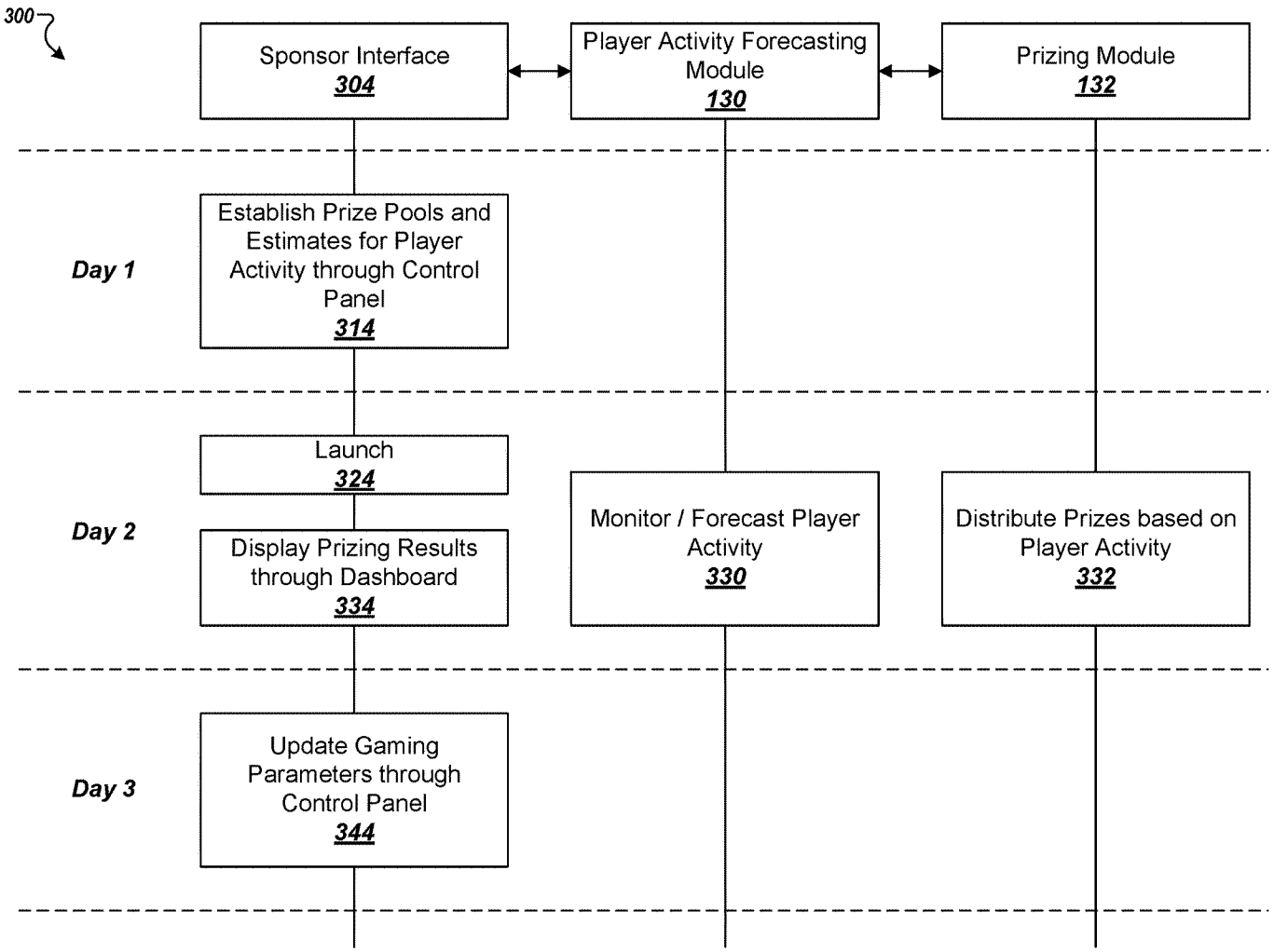

FIG. 3 illustrates an exemplary diagram 300 of the method described herein. Features including sponsor interface 304, player activity forecasting module 130, and prizing module 132, as depicted in the exemplary diagram 300 of FIG. 3, may be implemented to enable execution of this method. The sponsor interface 304 may, in some examples, provide a control panel and dashboard. In some examples, the sponsor interface 304 may be accessible to the sponsor of the sweepstakes through use of a client device that communicates with the computing device 120 over network 110.

The control panel provided by sponsor interface 304 may allow the sponsor to a) set the initial gaming parameters for the sweepstakes, such as estimates for player activity, the size and quantity of the prize pool(s), the duration of the sweepstakes, and the desired/target frequency for awarding intermediate prizes, and b) to change these parameters, if desired, as the sweepstakes progresses based on data from the actual performance of the sweepstakes. The control panel may also allow the sponsor to establish the degree of control that would be given to the player activity forecasting algorithm and prizing algorithm that are applied by the player activity forecasting module 130 and prizing module 132, respectively. In some implementations, the degree of control may range from manual, which may allow the sponsor to directly change gaming parameters, to "autopilot", which may allow for automatic gaming parameter management, as executed at least in part by one or more of the player activity forecasting algorithm and prizing algorithm.

In some implementations, the player activity forecasting module 130 monitors actual player activity within the one or more games in real-time and creates a forecast for player activity. The prizing module 132 may manage the distribution of prizes (e.g., either through mini-drawings or the random distribution) based on the gaming parameters set in the control panel and on player activity.

The dashboard provided by sponsor interface 304 may present the sponsor with data reflective of the performance of the one or more games and the sweepstakes. Such data may reflect one or more of performance by game, player segment data, forecasted performance (e.g. performance predictions, etc.) of the sweepstakes based on actual data, comparisons of actual vs. forecast data, comparisons of actual activity to the initial estimates, and the like.

In the exemplary diagram 300 of FIG. 3, a sponsor may establish the initial criteria for a sweepstakes on day 1 of the sweepstakes (314). On day 2, all games tied to the sweepstakes may launch (324). During day 2 the player activity forecasting module 130 may monitor player activity and provide, based at least on the monitored player activity, a forecast for this activity (330). In some implementations, the prizing module 132 may manage the distribution of prizes based at least on one or more of the gaming parameters, data supplied by the player activity forecasting module 130, and data provided by the sponsor in the control panel (332). The resulting distribution of prizes may be accessed and displayed on the dashboard (334). On day 3, the sponsor may, for instance, adjust gaming parameters and/or allow the algorithms applied by modules 130-132 to continue to update the distribution of prizes based on the player activity forecast and the parameters having been established, updated in the control panel, or both (344). While the method associated with the exemplary diagram 300 of FIG. 3 is described as occurring over the course of days, it is to be understood that the each sequential step of the method may occur at any point and duration of time.

This method supports two prizing structures for awarding intermediate prizes in digital sweepstakes games. In one structure, the mini-drawing structure, intermediate prizes are awarded through mini-drawings that are conducted intermittently over the course of the sweepstakes. In the other structure, a random distribution structure, intermediate prizes are randomly activated over the course of the sweepstakes and earned by players as they the play one or more games. Both structures may utilize one or more of in-game transactions or the completion of levels/achievements within the games as the mechanism for awarding the mini-prizes and for generating entries into the final/main drawing.

This method also supports a wide variety of options for configuring digital interactive sweepstakes games: a single game can be linked to a single prize pool, multiple games can be linked into a single prize pool, a single game can be linked to multiple prize pools, or multiple games can be linked to multiple prize pools.

Examples illustrating the use of this new method with each of the prizing structures, the Mini-drawing Structure and the Random Distribution Structure, are discussed below. Additionally, the application of this method with either prizing structure and multiple prize pools is also discussed below.

Figure 4A:
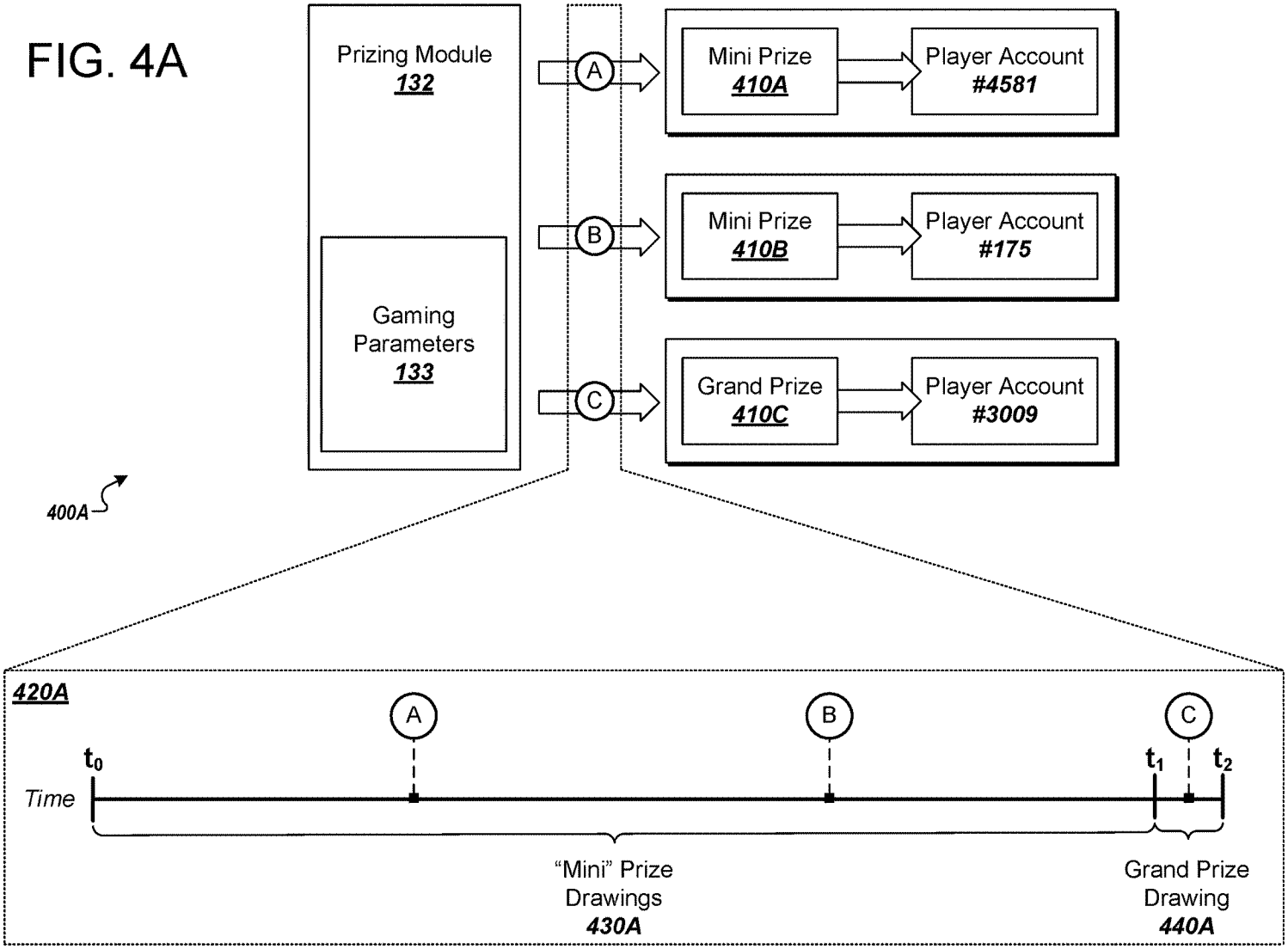
FIGS. 4A-5B are conceptual diagrams of exemplary frameworks for dynamically managing the distribution of prizes in a gaming system.

FIG. 4A is a conceptual diagram of an exemplary framework for using a mini-drawing structure to dynamically manage the distribution of prizes in a gaming system 400A. In some implementations, this process is executed with system 100 and/or 200. The diagram also depicts exemplary data that is communicated within gaming system 100 in time-sequenced stages "A" to "C," respectively. In this example, the prizing module 132 may distribute mini prize 410A to player account #4581 in stage A, mini prize 410B to player account #175, and grand prize 410C to player account #3009 in stage C. The prizing module 132 may, for instance, perform such actions based on player identification data, player activity data, player activity forecasts, and/or gaming parameters 133. Each of player account #4581, player account #175, and player account #3009 may have been randomly selected during the drawings of mini prize 410A, mini prize 410B, and grand prize 410C, respectively. For instance, entries corresponding to each of player account #4581, player account #175, and player account #3009 may have been randomly selected from among the multiple different sweepstakes entries maintained by computing device 120 during the drawings of mini prize 410A, mini prize 410B, and grand prize 410C, respectively. As demonstrated by timeline 420A, this prizing structure features a final/main drawing 440A (e.g., in stage C, between time $t_1$ and $t_2$) with high frequency, sequential "mini" drawings 430A that provide frequent rewards in advance of the final drawing over the course of the sweepstakes (e.g., in stages A and B, between time $t_0$ and $t_1$).

Drawings for mini prizes 410A-B may, for instance, be performed by the prizing module 132 in response to determining that one or more events have occurred. For example, mini prize 410A may have belonged to a particular prize pool for which the maximum number of sweepstakes entries is 1,000 entries and, up until stage A there were less than 1,000 entries for the particular prize pool, at which point the prizing module 132 determined that the $1{,}000^{th}$ entry for the particular prize pool had been received and proceeded to draw a winner for mini prize 410A. In other examples, the prizing module 132 may draw winners for mini prizes according to a predetermined schedule.

Figure 4B:
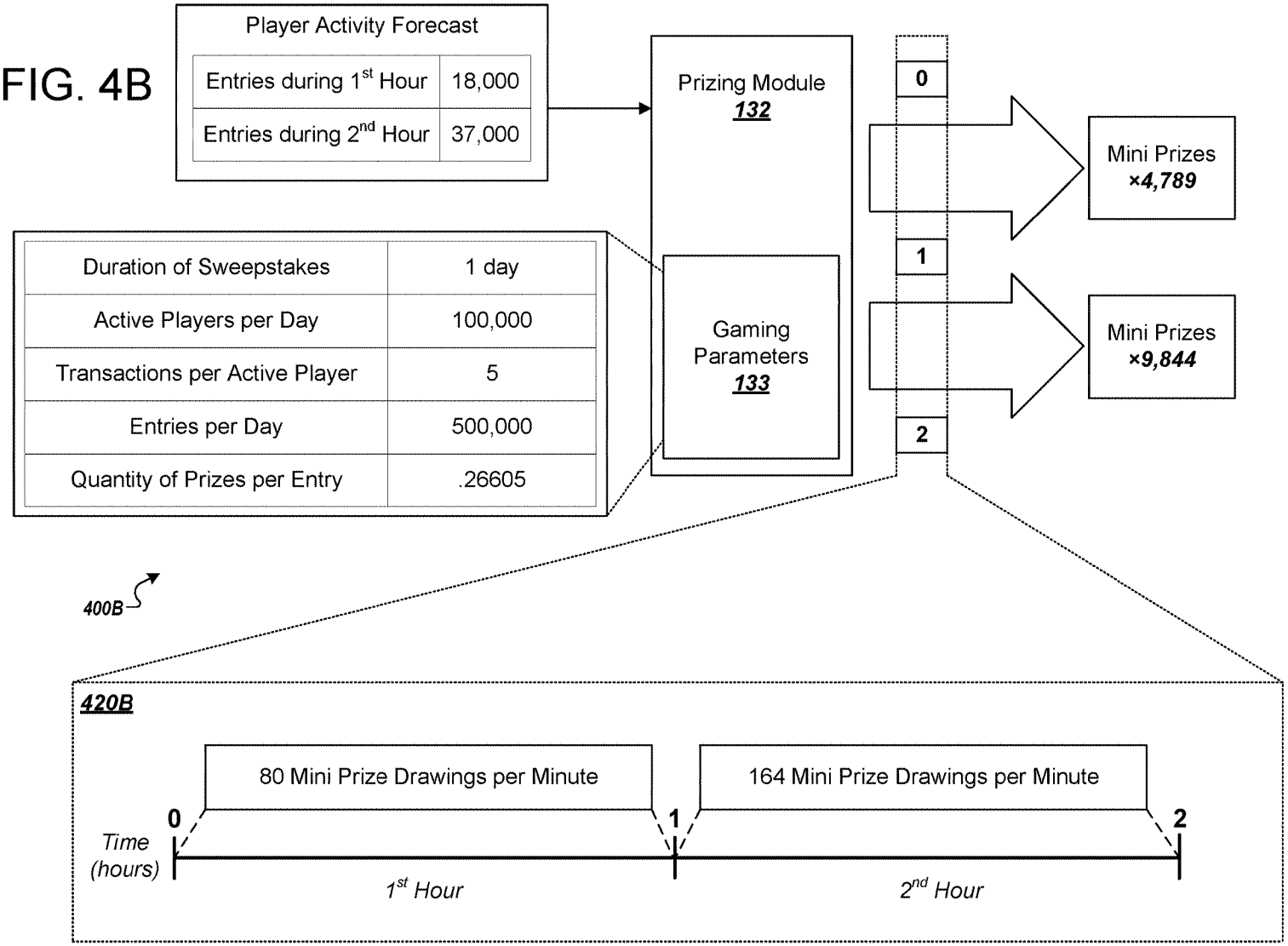

FIG. 4B depicts an example of an implementation of this prizing structure depicted in FIG. 4A with a digital interactive sweepstakes game involving one or more interactive games. The implementation is as follows: at the onset of the sweepstakes, the criteria for the mini-drawings would be established in the control panel. Such criteria and additional information provided through the control panel may be indicated in gaming parameters 133 and may include that which indicates the duration of the sweepstakes, an estimated quantity of players per day, an estimated quantity of transactions to be conducted by each player per day, an estimated quantity of sweepstakes entries per day, and a quantity of prizes to be distributed per entry. In this example, a sweepstakes has a duration of one day and the sponsor expects that 100,000 players may play the games, with each player generating 5 transactions per day for a total of 500,000 transactions/entries. For example, the sponsor may wish to distribute 86% of the anticipated revenue expected to be generated that day as prizes resulting in a prize fund of $215,000. The prize fund could be allocated across 133,025 prizes of varying values. In some examples, such information is reflected in gaming parameters 133.

Based on the data established in the control panel, 26.6605% of all entries (e.g. 133,025 out of 500,000) receive a prize over the course of the sweepstakes. This percentage can be seen as a predetermined ratio of number of prizes distributed to a number of prize entries, such as that described above in association with FIG. 1. In this example, the player activity forecasting module 130 may have provided a player activity forecast for the first hour of the sweepstakes in which 18,000 entries are expected. Therefore, it follows that the prizing algorithm would, in the first hour randomly select 4,789 prizes (26.6605% of the 18,000 entries expected within the first hour) from the prize pool, draw a winner for each prize, and distribute each prize to the account of the respective winner. As shown in timeline 420B, this may, for instance, correspond to a prize distribution rate of 80 mini prizes per minute for the first hour. The player activity forecasting module 130 may also have provided a player activity forecast for the second hour of the sweepstakes in which 37,000 entries are expected. Therefore, it follows that the prizing algorithm would, in the second hour, randomly select 9,844 prizes (26.6605% of the 37,000 entries expected within the second hour) from the prize pool, draw a winner for each prize, and distribute each prize to the account of the respective winner. As further shown in timeline 420B, this may, for instance, correspond to a prize distribution rate of 164 mini prizes per minute for the second hour. That is, the prizing module 132 adjusted its prize distribution rate from 80 mini prizes per minute to 164 mini prizes per minute so as to maintain the predetermined ratio of number of prizes distributed to number of prize entries of 26.6605%. In some examples, the mini prizes may be uniformly distributed over the course of each hour.

Figure 5A:
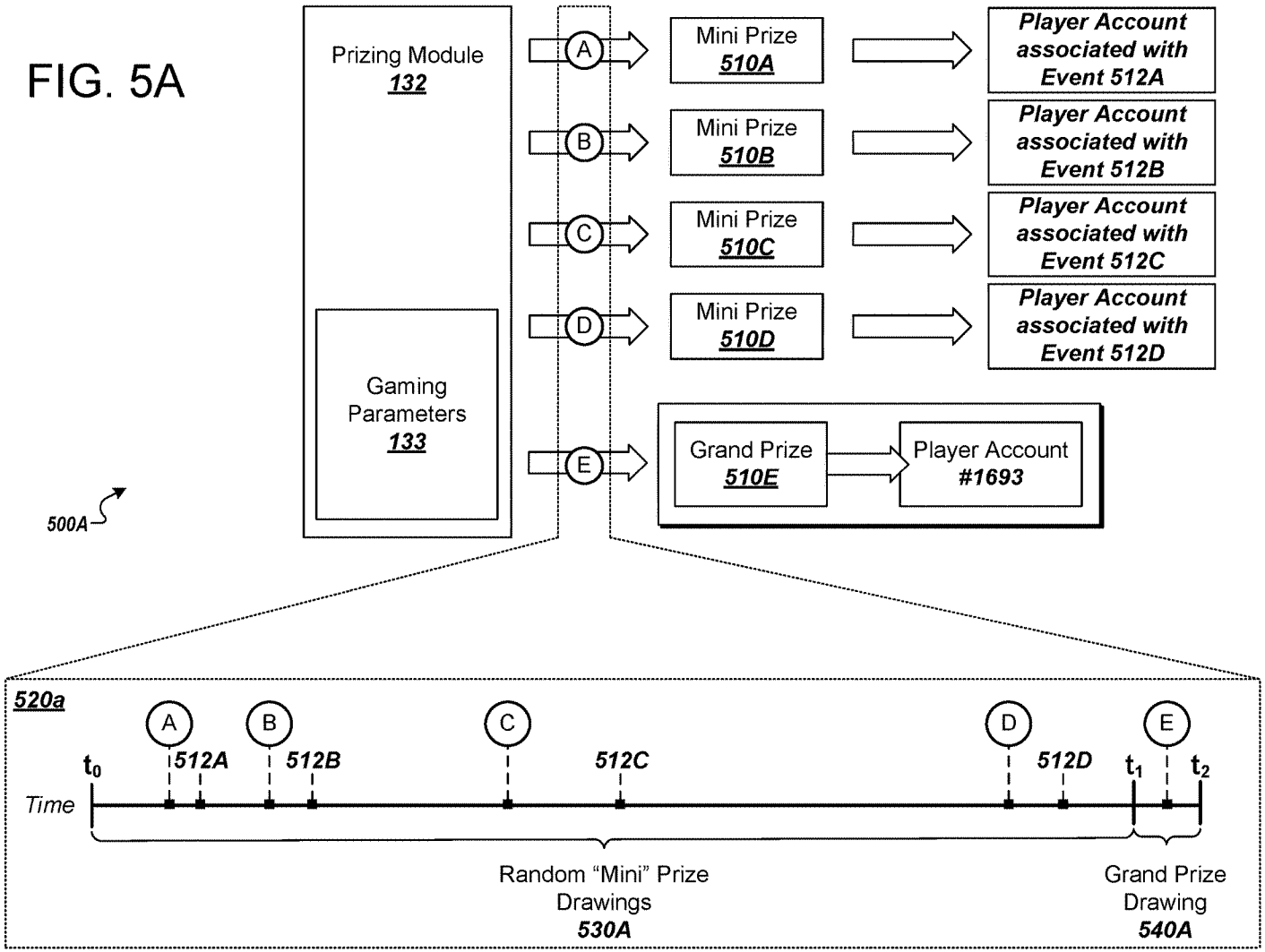

FIG. 5A is a conceptual diagram of an exemplary framework for using a mini-drawing structure to dynamically manage the distribution of prizes in a gaming system 500A. In some implementations, this process is executed with system 100 and/or 200. The diagram also depicts exemplary data that is communicated within gaming system 100 in time-sequenced stages "A" to "E," respectively. As demonstrated by timeline 520A, this prizing structure may feature a final/main "grand prize" drawing 540A (e.g., in stage E, between time $t_1$ and $t_2$), combined with "mini" prizes that are randomly activated over the course of the sweepstakes (e.g., in stages A-D, between time $t_0$ and $t_1$) and distributed to sweepstakes winners. The prizing module 132 may, for instance, perform such actions based on player identification data, player activity data, player activity forecasts, and/or gaming parameters 133.

In some examples, players may be able to conduct in-game transactions to acquire additional powers, lives, or to access different levels within the game. For the awarding of the mini prizes, an algorithm randomly selects and "activates" a prize from the prize pool at random times over the course of the sweepstakes. In the example of FIG. 5A, the prizing module 132 may activate mini prize 510A in stage A, mini prize 510B in stage B, mini prize 510C in stage C, and mini prize 510D in stage D. The distribution of prizes may be completely random, and the prize pool for the mini prizes (e.g. number, type of prizes, etc.) may remain fixed for the duration of the sweepstakes.

In such examples, the particular player that conducts an in-game transaction after a prize has been activated would win that prize. In the example of FIG. 5A, the prizing module 132 may distribute activated mini prize 510A to the player account associated with event 512A in response to the occurrence of event 512A, activated mini prize 510B to the player account associated with event 512B in response to the occurrence of event 512B, activated mini prize 510C to the player account associated with event 512C in response to the occurrence of event 512C, activated mini prize 510D to the player account associated with event 512D in response to the occurrence of event 512D, and grand prize 510E to player account #1693 in stage E. Player account #1693 may, for example, be that which was randomly selected during the drawing of grand prize 510E. For instance, an entry corresponding to player account #1693 may have been randomly selected from among the multiple different sweepstakes entries maintained by computing device 120 during the drawing of grand prize 510E.

For instance, event 512A may represent the first in-game transaction conducted following the activation of mini prize 510A in stage A. It follows that the account associated with the transaction represented by event 512A will receive mini prize 510A. In response to the random activation of mini prize 510A and the occurrence of event 512A, the prizing module may distribute mini prize 510A to the user whose account was involved in the transaction represented by event 512A. In some examples, this may correspond to prizing module 132 transferring funds to the player account associated with event 512A.

Figure 5B:
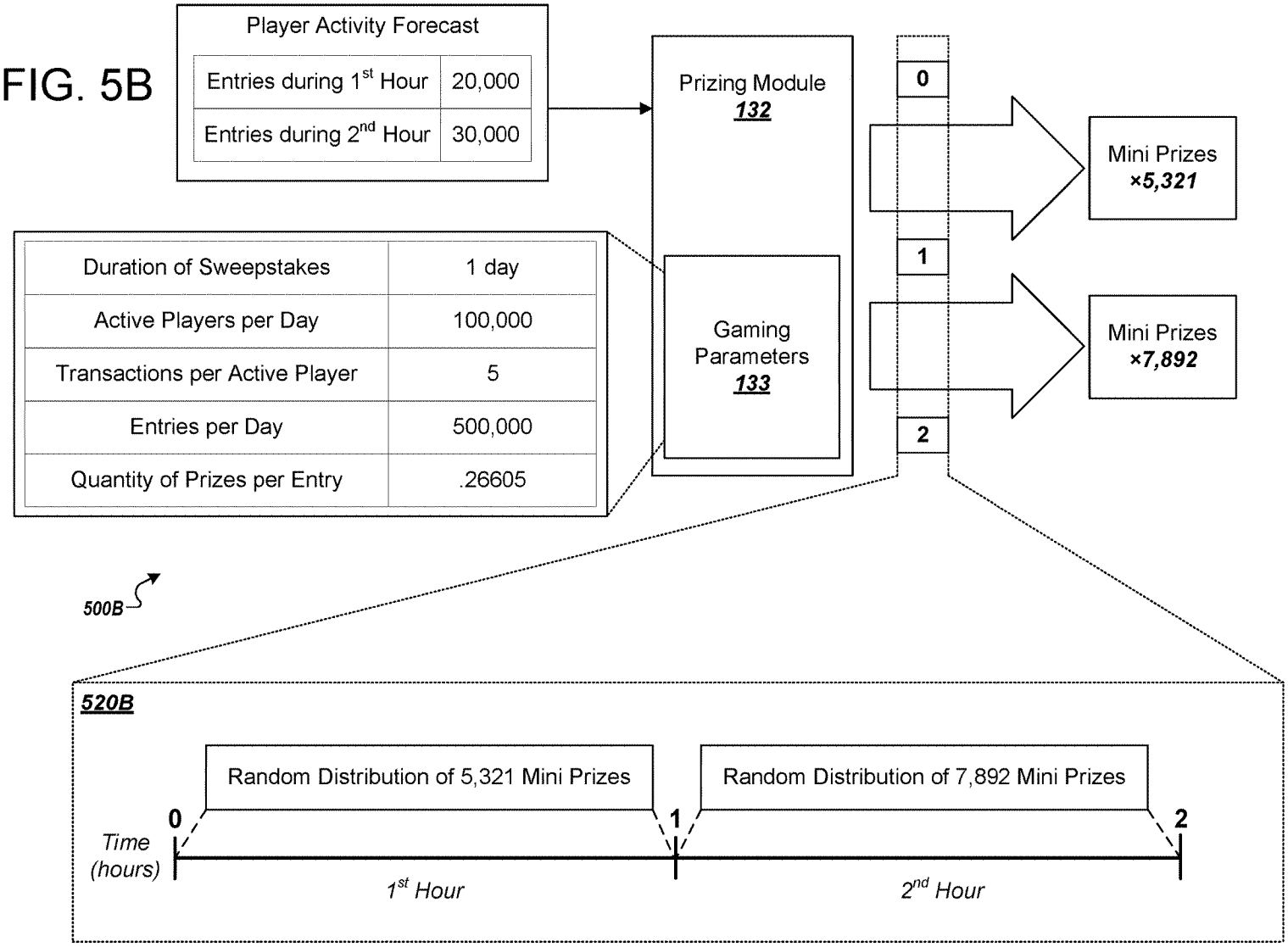

FIG. 5B depicts an example of an implementation of this prizing structure depicted in FIG. 5A with a digital interactive sweepstakes game involving one or more interactive games. The implementation is as follows: at the onset of the sweepstakes, the criteria for the mini-drawings would be established in the control panel. Such criteria and additional information provided through the control panel may be indicated in gaming parameters 133 and may include that which indicates the duration of the sweepstakes, an estimated quantity of players per day, an estimated quantity of transactions to be conducted by each player per day, an estimated quantity of sweepstakes entries per day, and a quantity of prizes to be distributed per entry. In this example, a sweepstakes has a duration of one day and the sponsor expects that 100,000 players may play the games, with each player generating 5 transactions per day for a total of 500,000 transactions/entries. For example, the sponsor may wish to distribute 86% of the anticipated revenue expected to be generated that day as prizes resulting in a prize fund of $215,000. The prize fund could be allocated across 133,025 prizes of varying values. In some examples, such information is reflected in gaming parameters 133.

Based on the data established in the control panel, 26.6605% of all entries (e.g. 133,025 out of 500,000) receive a prize over the course of the sweepstakes. This percentage can be seen as a predetermined ratio of number of prizes distributed to a number of prize entries, such as that described above in association with FIGS. 1 and 4B. In this example, the player activity forecasting module 130 may have provided a player activity forecast for the first hour of the sweepstakes in which 20,000 entries are expected. Therefore, it follows that the prizing algorithm would, in the first hour randomly select 5,321 prizes (26.6605% of the 20,000 entries expected within the first hour) from the prize pool, draw a winner for each prize, and distribute each prize to the account of the respective winner. As shown in timeline 520B, this may, for instance, correspond to a random distribution of 5,321 mini prizes in the first hour. The player activity forecasting module 130 may also have provided a player activity forecast for the second hour of the sweepstakes in which 30,000 entries are expected. Therefore, it follows that the prizing algorithm would, in the second hour, randomly select 7,892 prizes (26.6605% of the 30,000 entries expected within the second hour) from the prize pool, draw a winner for each prize, and distribute each prize to the account of the respective winner. As further shown in timeline 520B, this may, for instance, correspond to a random distribution of 7,892 mini prizes in the second hour. That is, the prizing module 132 adjusted its prize distribution rate from an average of 5,321 mini prizes per hour to an average of 7,892 mini prizes per hour so as to maintain the predetermined ratio of number of prizes distributed to number of prize entries of 26.6605%. Although average prize distribution rates are maintained over the course of each hour, the instantaneous prize distribution rate may fluctuate over the course of each hour as prizes are being activated at random times and distributed to winners in response to the first transaction to occur following activation.

The techniques described in association with FIGS. 4A-5B may also allow for multiple prize pools to be launched and managed simultaneously within a sweepstakes. In this example, each "price point" within a game or across multiple games would be tied to a specific prize pool. It is to be understood that the dollar symbol is used for convenience, since this method supports any virtual or real currency. In some implementations, this process is executed with system 100 and/or 200.

In some implementations, the sponsor may set the parameters for each prize pool in the control panel, and the player activity forecasting algorithm and prizing algorithm may monitor each prize pool independently, and if activity in one category is low and there is risk that prizes may remain unclaimed at the close of the sweepstakes, may re-allocate prizes across the prize pools. For example, if there was $1,000 in the 0.25 prize pool remaining towards the close of the sweepstakes the algorithms would be able to highlight this to the sponsor, and the sponsor would be able to re-allocate the funds where needed.

Figure 6:
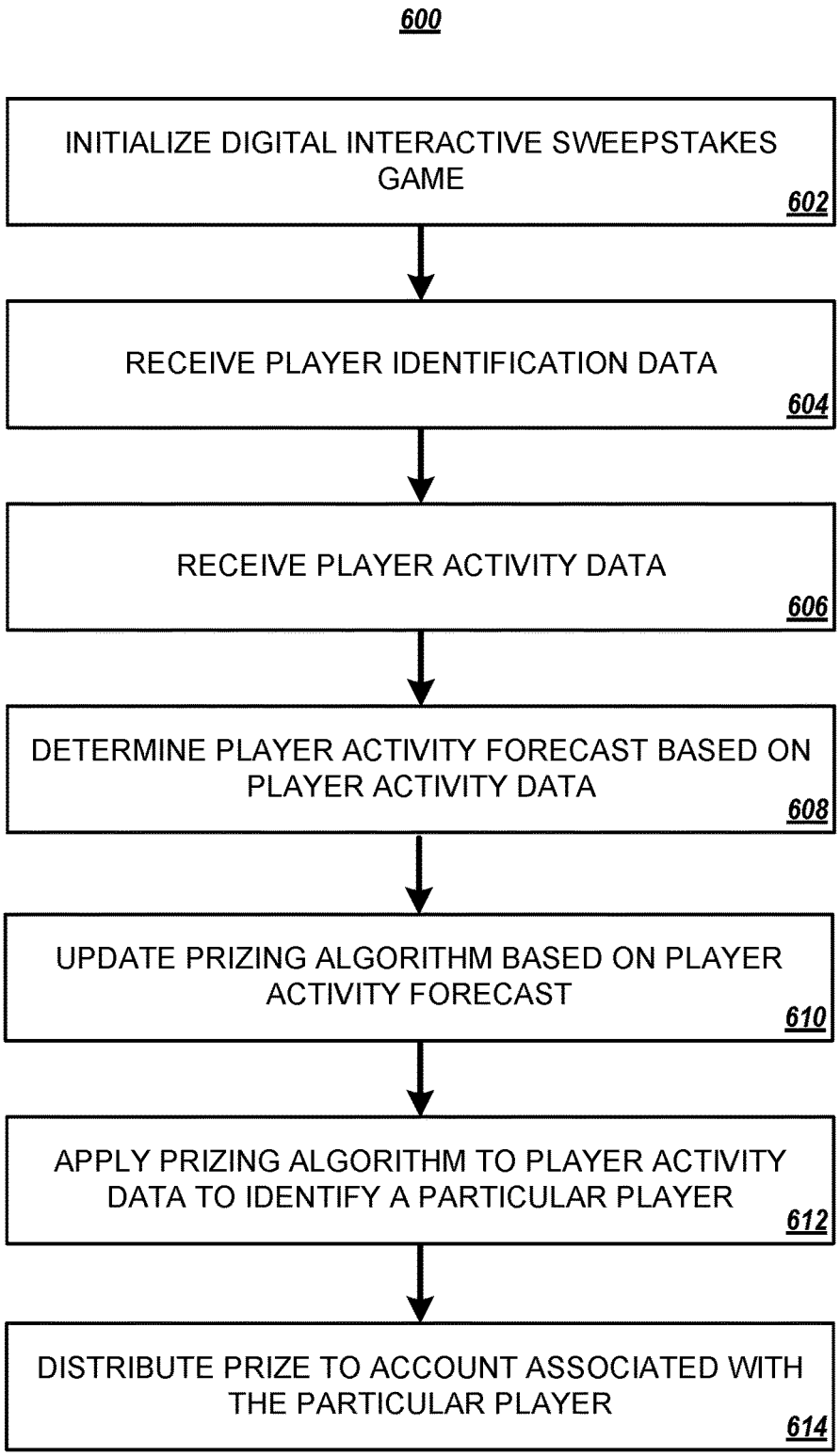
FIG. 6 is a flow chart of an example process for dynamically managing the distribution of prizes in a gaming system.

FIG. 6 illustrates exemplary process 600 for dynamically managing the distribution of prizes in a gaming system. The following describes the process 600 as being performed by components of systems that are described with reference to FIGS. 1-5B. However, the process 600 may be performed by other systems or system configurations. Briefly, the process 600 may include initializing a digital interactive sweepstakes game (602), receiving player identification data (604), receiving player activity data (606), determining a player activity forecast based on the player activity data (608), updating a prizing algorithm based on the player activity forecast (612), applying the prizing algorithm to player activity data to identify a particular player (612), and distributing a prize to an account associated with the particular player (614).

In more detail, the process 600 may include initializing a digital interactive sweepstakes game (602), where initialization of the digital interactive sweepstakes game includes setting one or more game parameters. For example, this may correspond to a sweepstakes that is launched by a sponsor using sponsor interface 304 and maintained at least in part by prizing module 132 of computing device 120 that stores gaming parameters 133.

The process 600 may include receiving, at an electronic processor, player identification data from a plurality of card acceptor terminals (604), each of which is coupled to a different corresponding gaming device, where the player identification data from each card acceptor terminal is received responsive to the operation of a corresponding card at the card acceptor terminal. For example, this may correspond to computing device 120 receiving data such as player ID 108A from the card acceptor terminal 107A that is coupled to gaming device 106A after dedicated payment card 103A has been presented to card acceptor terminal 107A. This may further correspond to the set of player IDs 128 that the computing device 120 receives from multiple gaming devices in addition to gaming device 106A. Such multiple gaming devices may also include or be communicatively coupled with card acceptors.

The process 600 may include receiving at the processor, from the plurality of gaming devices, player activity data while the gaming devices are played (606). For example, this may correspond to computing device 120 receiving data such as player activity data 109A from gaming device 106A while user 102A is playing a game on gaming device 106A. This may further correspond to the sets of player activity data 129 that the computing device 120 receives from multiple gaming devices in addition to gaming device 106A.

The process 600 may include determining, by the processor, a player activity forecast based, at least in part, on the received player activity data (608). For example, this may correspond to the player activity forecasting module 130, through which a player activity forecasting algorithm is applied, determining a player activity forecast based at least on sets of player activity data 129. The player activity forecast may, for instance, include an estimate of a number of prize entries over a predetermined time period. This may, for instance, correspond to one or more of the entry projections described in association with FIGS. 4B and 5B.

The process 600 may include updating a prizing algorithm based on the player activity forecast (610). For example, this may correspond to the prizing module 132 updating one or more gaming parameters 133 according to the player activity forecast provided as output by the player activity forecasting module 132.

The process 600 may include applying, by the processor, the prizing algorithm to the received player activity data to identify a particular player to which a prize is to be distributed (612). For example, this may correspond to the prizing module 132, through which the prizing algorithm is applied, identifying the winner of a particular mini prize by virtue of the winner (i) having been randomly selected through a drawing for the particular mini prize performed by the prizing module 132 under the mini-drawing prizing structure, or (ii) having been the first player to conduct a transaction after an activation of the particular mini prize by the prizing module 132 under the random distribution prizing structure. The prizing module 132 may, for instance, apply the prizing algorithm to sets of player activity data 129 to identify the particular player to which the prized is to be distributed, and may do so based further on set of player IDs 128 and gaming parameters 133.

The process 600 may, responsive to identifying the particular player to which the prize is to be distributed, include distributing the prize to a player account that is associated with the particular player and that is identified by the player identification data (614). For example, this may correspond to the prizing module 132 distributing a prize to its winner. In some examples, distributing the prize to the player account associated with the particular player may include transmitting prize data from the processor to the player account stored on a card operated at one of the card acceptor terminals. In an example in which user 102A wins the particular prize, this may correspond to the prizing module 132 transmitting additional funds to the player account that is associated with dedicated payment card 103A, which is that of user 102A.

In some implementations, the process 600 may further include updating the one or more game parameters based, at least in part, on the player activity data, where the one or more game parameters include a size of a prize pool, a quantity of prizes to be distributed from the prize pool, and/or a target frequency for awarding prizes from the prize pool. For example, this may correspond to the prizing module 132 adjusting its prize distribution rate or another one of gaming parameters 133 according to the player activity forecast provided as output by the player activity forecasting module 130. In some instances, updating the game parameters based on the player activity data may include changing the size of the prize pool, changing the quantity of prizes to be distributed from the prize pool, and/or changing the duration of the sweepstakes.

In some implementations, the process 600 may further include outputting to a display, an interactive dashboard control panel, the interactive dashboard control panel including one or more interactive controls that allow a user to modify the one or more game parameters including a size of a prize pool, a quantity of prizes to be distributed from the prize pool, and/or a target frequency for awarding prizes from the prize pool. For example, this may correspond to the control panel and/or dashboard that is provided by sponsor interface 304.

In some examples, the prizing algorithm may include randomly activating prizes from the prize pool according to a prize distribution rate so as to maintain a predetermined ratio of number of prizes distributed to a number of prize entries, and where the method includes updating the prize distribution rate based on the player activity forecast. For example, this may correspond to the prizing module 132, as described in association with FIG. 5B, randomly activating and distributing 5,321 mini prizes over the course of the first hour of the sweepstakes in response to the player activity forecast provided by the player activity forecasting module 130 indicating that 20,000 entries are expected within the first hour of the sweepstakes. In this way, the prizing module 132 maintains the predetermined ratio of number of prizes distributed to number of prize entries 26.6605%, as the value of 5,321 represents 26.6605% of the value of 20,000. In one aspect, updating the prize distribution rate based on the player activity forecast may include increasing the prize distribution rate responsive to an increase in the player activity forecast and decreasing the prize distribution rate responsive to a decrease in the player activity forecast. This may, for instance, correspond to the prizing module 132, as described in association with FIG. 5B, increasing the prize distribution rate for the second hour of the sweepstakes, from 5,321 mini prizes per hour to 7,892 mini prizes per hour, in response to the player activity forecast provided by the player activity forecasting module 130 indicating that 30,000 entries are expected within the second hour of the sweepstakes, which represents an increase from the 20,000 entries that were expected within the first hour of the sweepstakes.

In some implementations, the prizing algorithm may include activating prizes from the prize pool according to a predetermined schedule, and where the method includes modifying the predetermined schedule based on the player activity forecast. For example, this may correspond to the prizing module 132, as described in association with FIG. 4B, distributing 4,789 mini prizes over the course of the first hour of the sweepstakes (e.g., at a uniform rate of 80 mini prizes per minute) in response to the player activity forecast provided by the player activity forecasting module 130 indicating that 18,000 entries are expected within the first hour of the sweepstakes. In this way, the prizing module 132 maintains the predetermined ratio of number of prizes distributed to number of prize entries 26.6605%, as the value of 4,789 represents 26.6605% of the value of 18,000. In one aspect, modifying the predetermined schedule based on the player activity forecast may include increasing a frequency with which prizes are activated responsive to an increase in player activity forecast and decreasing a frequency with which prizes are distributed responsive to a decrease in the player activity forecast. This may, for instance, correspond to the prizing module 132, as described in association with FIG. 4B, increasing the uniform prize distribution rate for the second hour of the sweepstakes, from 80 mini prizes per minute to 164 mini prizes per minute, in response to the player activity forecast provided by the player activity forecasting module 130 indicating that 37,000 entries are expected within the second hour of the sweepstakes, which represents an increase from the 18,000 entries that were expected within the first hour of the sweepstakes.

In some implementations, the prizing algorithm may include specifying a predetermined trigger event, activating the prize from the prize pool according to a prize distribution rate or according to a predetermined schedule, identifying, from the player activity data, the predetermined trigger event to occur subsequent to activating the prize, and identifying the particular player having caused the predetermined trigger event as the particular player to which the activated prize should be distributed. For example, this may correspond to the prizing module 132 determining that a trigger event such as event 512A has occurred and, in response, identifying the particular player that conducted the transaction that even 512A represents. In some examples, the predetermined trigger event may be an event in which a game is initiated on one of multiple gaming devices or an event in which an action is performed within a game being played on one of multiple gaming devices.

Although described within the context of arcade gameplay and in-game transactions, it is to be understood that the principles of the techniques described in association with FIGS. 1-6 may be applied to a variety of other contexts. For example, such techniques may be leveraged to enhance consumer experience associated with conducting transactions in brick-and-mortar or online marketplaces. In such examples, the dedicated payment cards described herein may include credit cards, debit cards, gift cards, and the like, with "qualifying events" that correspond to conducting transactions at such marketplaces. Similarly, the card acceptor terminals and/or gaming devices described herein may include payment terminals, point of sale ("POS") registers or other terminals/devices located at checkouts of retail environments, automated teller machines, and the like.

Figure 7:
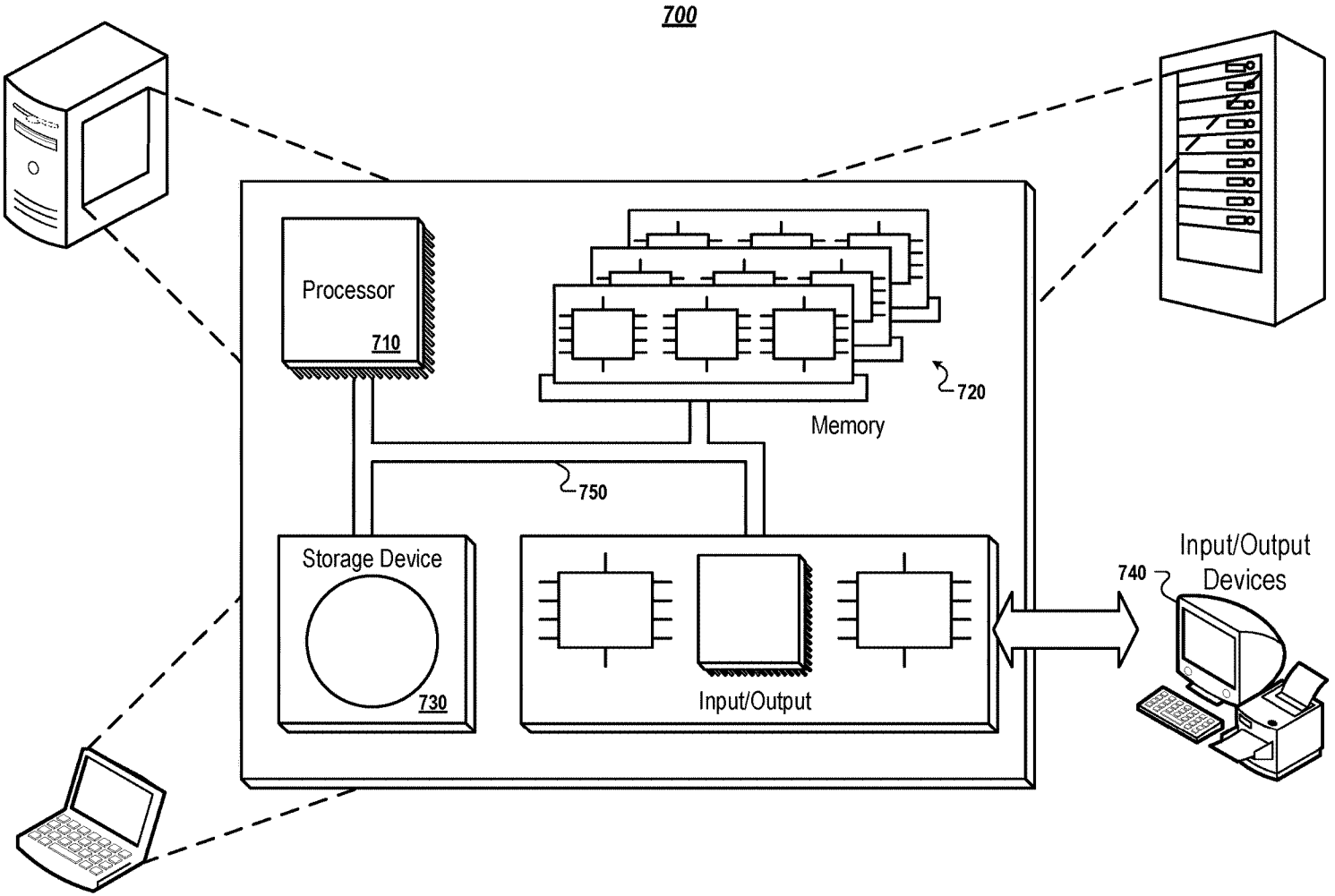
FIG. 7 is a diagram of exemplary computing devices.

FIG. 7 is a schematic diagram of an example of a generic computer system 700. The system 700 can be used for the operations described in association with the processes described above according to some implementations. The system 700 may be included in system 100, 200, and 400A-500B.

The system 700 includes a processor 710, a memory 720, a storage device 730, and an input/output device 740. Each of the components 710, 720, 730, and 740 are interconnected using a system bus 750. The processor 710 is capable of processing instructions for execution within the system 700. In one implementation, the processor 710 is a single-threaded processor. In another implementation, the processor 710 is a multi-threaded processor. The processor 710 is capable of processing instructions stored in the memory 720 or on the storage device 730 to display graphical information for a user interface on the input/output device 740.

The memory 720 stores information within the system 700. In one implementation, the memory 720 is a computer-readable medium. In one implementation, the memory 720 is a volatile memory unit. In another implementation, the memory 720 is a non-volatile memory unit.

The storage device 730 is capable of providing mass storage for the system 700. In one implementation, the storage device 730 is a computer-readable medium. In various different implementations, the storage device 730 may be a floppy disk device, a hard disk device, an optical disk device, or a tape device.

The input/output device 740 provides input/output operations for the system 700. In one implementation, the input/output device 740 includes a keyboard and/or pointing device. In another implementation, the input/output device 740 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, e.g., in a machine-readable storage device, for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

A number of implementations have been described. Nevertheless, it will be understood that various modifications may be made without departing from the spirit and scope of the disclosure. Accordingly, other implementations are within the scope of the following claims.

What is claimed is:

1. A method for the dynamic distribution of prizes, the method comprising:

initializing a digital interactive sweepstakes game, wherein initialization of the digital interactive sweepstakes game comprises setting one or more game parameters;

receiving, at an electronic processor, player identification data from a plurality of card acceptor terminals, each card acceptor terminal being coupled to a different corresponding gaming device, wherein the player identification data from each card acceptor terminal is received responsive to the operation of a corresponding card at the card acceptor terminal;

receiving at the processor, from the plurality of gaming devices, player activity data while the gaming devices are played;

determining, by the processor, a player activity forecast based, at least in part, on the received player activity data, the player activity forecast comprising an estimate of a number of prize entries over a predetermined time period;

updating a prizing algorithm based on the player activity forecast to obtain an updated prizing algorithm, wherein updating the prizing algorithm comprises increasing a prize distribution rate responsive to an increase in the player activity forecast and/or decreasing the prize distribution rate responsive to a decrease in the player activity forecast;

applying, by the processor, the updated prizing algorithm to the received player activity data to identify a particular player to which a prize is to be distributed, wherein applying the updated prizing algorithm comprises activating random prizes from the prize pool according to the prize distribution rate so as to maintain a predetermined ratio of number of prizes distributed to a number of prize entries; and responsive to identifying the particular player to which the prize is to be distributed, distributing the prize to a player account that is associated with the particular player and that is identified by the player identification data.

2. The method of claim 1, wherein distributing the prize to the player account associated with the particular player comprises transmitting prize data from the processor to the player account stored on a card operated at one of the card acceptor terminals.

3. The method of claim 1, comprising updating the one or more game parameters based, at least in part, on the player activity data, wherein the one or more game parameters comprise a size of a prize pool, a quantity of prizes to be distributed from the prize pool, and/or a target frequency for awarding prizes from the prize pool.

4. The method of claim 3, wherein updating the game parameters based on the player activity data comprises changing the size of the prize pool, changing the quantity of prizes to be distributed from the prize pool, and/or changing the duration of the sweepstakes.

5. The method of claim 1, further comprising, outputting to a display, an interactive dashboard control panel, the interactive dashboard control panel comprising:

one or more interactive controls that allow a user to modify the one or more game parameters including a size of a prize pool, a quantity of prizes to be distributed from the prize pool, and/or a target frequency for awarding prizes from the prize pool.

6. A system comprising:

a plurality of card acceptor terminals;

a plurality of gaming devices, wherein each card acceptor terminal of the plurality of card acceptor terminals, is coupled to a different corresponding gaming device; and an electronic processor operable to:

initialize a digital interactive sweepstakes game, wherein initialization of the digital interactive sweepstakes game comprises setting one or more game parameters;

receive player identification data from the plurality of card acceptor terminals, wherein the player identification data from each card acceptor terminal is received responsive to the operation of a corresponding card at the card acceptor terminal;

receive, from the plurality of gaming devices, player activity data while the gaming devices are played;

determine a player activity forecast based, at least in part, on the received player activity data;

update a prizing algorithm based on the player activity forecast, wherein updating the prizing algorithm comprises increasing a prize distribution rate responsive to an increase in the player activity forecast and/or decreasing the prize distribution rate responsive to a decrease in the player activity forecast;

apply the updated prizing algorithm to the received player activity data to identify a particular player to which a prize is to be distributed, wherein applying the updated prizing algorithm comprises activating random prizes from the prize pool according to the prize distribution rate so as to maintain a predetermined ratio of number of prizes distributed to a number of prize entries; and responsive to identifying the particular player to which the prize is to be distributed, distribute the prize to a player account that is associated with the particular player and that is identified by the player identification data.

7. The system of claim 6, wherein the electronic processor is operable to distribute the prize to the player account associated with the particular player by transmitting prize data to the card operated at one of the card acceptor terminals.

* * * * *